US008169130B2

(12) United States Patent
Fanton et al.

(10) Patent No.: US 8,169,130 B2
(45) Date of Patent: May 1, 2012

(54) PLANAR OR SUBSTANTIALLY PLANAR LUMINOUS STRUCTURE

(75) Inventors: Xavier Fanton, Aulnay sour Bois (FR); Thomas Bertin-Mourot, Paris (FR); Guillaume Auday, Saint Ouen (FR); Jingwei Zhang, Massy (FR)

(73) Assignee: Saint-Gobain Glass France, Courbevoie (FR)

( * ) Notice: Subject to any disclaimer, the term of this patent is extended or adjusted under 35 U.S.C. 154(b) by 570 days.

(21) Appl. No.: 11/816,487

(22) PCT Filed: Feb. 22, 2006

(86) PCT No.: PCT/FR2006/050155

§ 371 (c)(1),
(2), (4) Date: Oct. 5, 2007

(87) PCT Pub. No.: WO2006/090085

PCT Pub. Date: Aug. 31, 2006

(65) Prior Publication Data

US 2008/0158855 A1 Jul. 3, 2008

(30) Foreign Application Priority Data

Feb. 22, 2005 (FR) ..... 05 50487

(51) Int. Cl.
*F21V 9/16* (2006.01)
*G02F 1/07* (2006.01)

(52) U.S. Cl. ..... 313/484; 313/234

(58) Field of Classification Search ..... 313/498, 313/234, 607, 484
See application file for complete search history.

(56) References Cited

U.S. PATENT DOCUMENTS

| | | | | |
|---|---|---|---|---|
| 5,319,282 | A * | 6/1994 | Winsor | 315/169.4 |
| 6,552,843 | B1 | 4/2003 | Tench et al. | |
| 2002/0079826 | A1 * | 6/2002 | Park | 313/483 |
| 2003/0098643 | A1 * | 5/2003 | Park et al. | 313/495 |
| 2004/0160538 | A1 | 8/2004 | Li et al. | |
| 2006/0091807 | A1 * | 5/2006 | Bertin-Mourot et al. | |
| 2007/0133078 | A1 * | 6/2007 | Fanton et al. | |

FOREIGN PATENT DOCUMENTS

| | | | |
|---|---|---|---|
| FR | 2 843 483 | A1 | 2/2004 |
| WO | WO 01/44717 | A1 | 6/2001 |

OTHER PUBLICATIONS

U.S. Appl. No. 12/596,069, filed Oct. 15, 2009, Auday, et al.
U.S. Appl. No. 12/596,305, filed Oct. 16, 2009, Joulaud, et al.
U.S. Appl. No. 11/816,549, filed Aug. 17, 2007, Auday, et al.*
D. M. Tench, et al., "Reversible Electrochemical Mirror (REM) Smart Window", Electrochemical Society Proceedings, XP 009049204, vol. 2003-17, 2003, pp. 190-196.

* cited by examiner

*Primary Examiner* — Karabi Guharay
*Assistant Examiner* — Elmito Breval
(74) *Attorney, Agent, or Firm* — Oblon, Spivak, McClelland, Maier & Neustadt, L.L.P.

(57) ABSTRACT

A flat or substantially flat luminous structure including two walls having main faces facing one another and defining an internal space, a light source placed in the internal space and a power supply for the light source, and at least one substantially transparent part or an overall transparent part forming at least one light well. The structure is capable of illuminating via at least one luminous region of at least one of the main faces, an element having a reflective surface that reflects visible light, placed facing at least one part of the luminous region. The element is switchable and the reflective surface is capable of becoming a substantially transparent surface or an overall transparent surface over at least one area, and vice versa.

23 Claims, 5 Drawing Sheets

PLANAR OR SUBSTANTIALLY PLANAR LUMINOUS STRUCTURE

Figure 1:
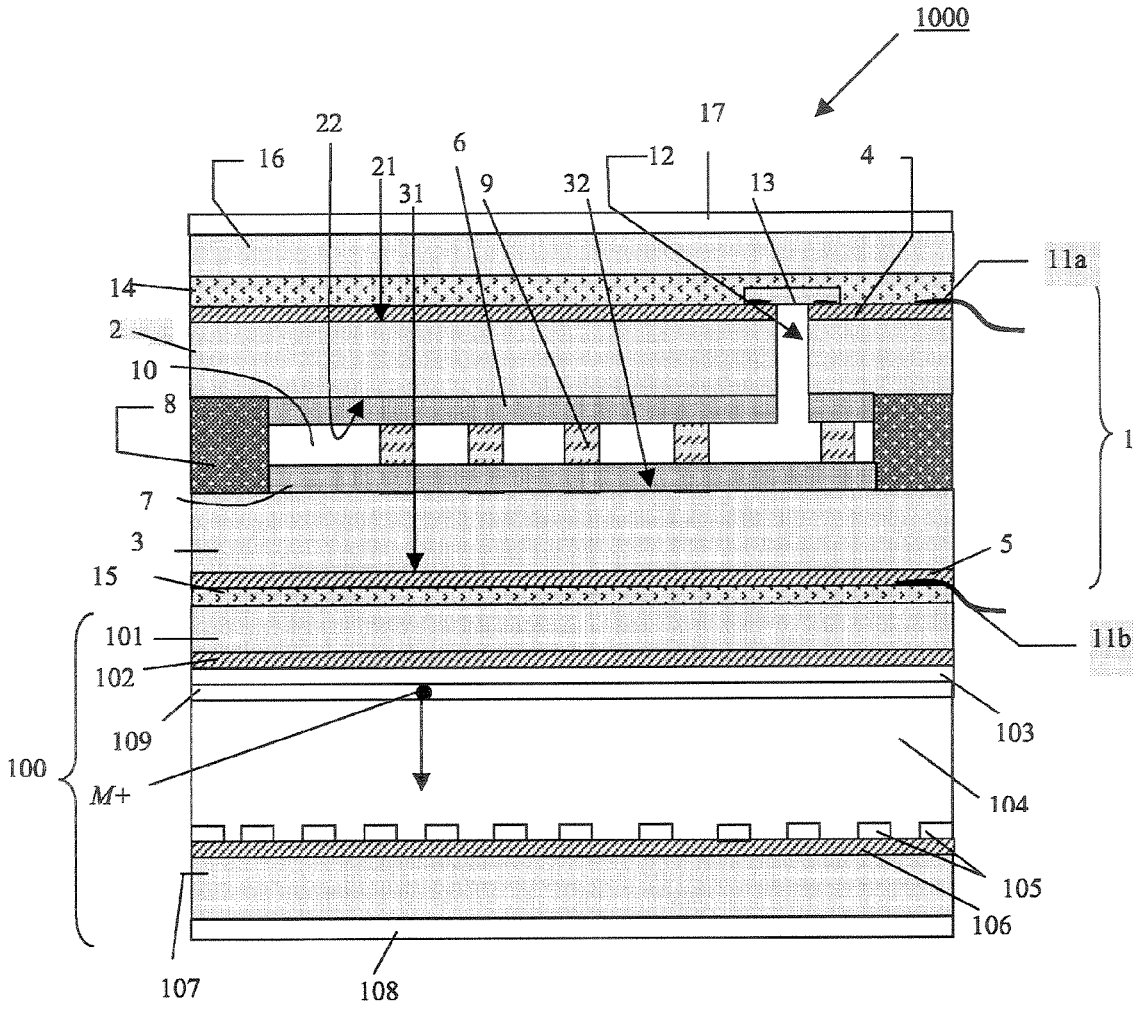

The present invention relates to a luminous structure, and more precisely to a luminous structure comprising two walls having main faces facing each other and defining an internal space, a light source placed in the internal space and a power supply for said source, the structure having at least one substantially transparent part or an overall transparent part for forming at least one light well and the structure being capable of illuminating via at least one luminous region of at least one of said main faces, an element having a reflective surface that reflects in the visible, placed facing at least one part of the luminous region.

Among known luminous structures there are flat lamps used in general for the manufacture of backlit display devices. These flat lamps may consist of two glass sheets held together with a small gap between them, generally of less than a few millimeters, the sheets being hermetically sealed so as to contain a gas under reduced pressure in which an electrical discharge produces radiation generally in the ultraviolet range, which excites a photoluminescent material, of the type usually called phosphors, which then emits visible light.

In a known structure, a first glass sheet bears, on one and the same face, two screen-printed coatings, especially made of silver, in the form of interpenetrating combs constituting a cathode and an anode. This face, called the internal face, is turned toward the space containing the plasma gas. A second glass sheet is kept at a certain distance from the first by means of discrete spacers and possibly a peripheral frame. Produced between the anode and the cathode is what is called a "coplanar" discharge, that is to say one along a direction hugging the main surface of the glass substrate, which discharge excites the surrounding plasma gas. The electrodes are protected by a dielectric coating intended, by capacitive limitation of the current, to prevent a loss of material of the electrodes by ion bombardment in the vicinity of the glass substrate. The internal face of the second glass sheet is coated with a coating of photoluminescent material.

Moreover, there is an increasing demand for what is called "smart" glazing, certain properties of which may be varied at will.

Document U.S. Pat. No. 6,679,617 discloses a flat lamp that can be used as a window, that is to say capable of transmitting visible light in the "off" state (with no voltage applied), and capable of illuminating in the "on" state (with voltage applied) a room and/or the outside, for example.

To do this, the photoluminescent coating is present only in certain regions of the internal face of the second glass sheet, thus defining luminous regions—for example in the form of bands—the mutual spacing of which increases in one direction. Furthermore, to increase the illumination of the room, the second glass sheet includes, on its external face, reflective bands facing the luminous bands. The improvement in illumination of the room is therefore achieved at the expense of light transmission.

The object of the invention is to propose a luminous structure—which is flat or substantially flat, or more broadly elongate—capable of providing optimum illumination while maintaining satisfactory light transmission.

For this purpose, the subject of the invention is a luminous structure comprising:

- two walls having main faces facing one another and defining an internal space;
- a light source placed in the internal space and a power supply for said source;

the structure having at least one substantially transparent part or an overall transparent part for forming at least one light well and the structure being capable of illuminating via at least one luminous region of at least one of said main faces;

- an element having a reflective surface that reflects in the visible, placed facing at least one part of the luminous region, said element being switchable and said reflective surface being capable of becoming a substantially transparent surface or an overall transparent surface over at least one area, and vice versa.

Thus, the switchable element associated with the luminous structure makes it possible to obtain the desired performance in terms of both light transmission and illumination.

In general, the structure may be fitted into any window, of a building or means of locomotion (train windows, ship or aircraft cabin windows, side windows of industrial vehicles, or even portions of rear windows or windshields).

It is also conceivable for the structure according to the invention to be fitted into glazing units, internal partitions between rooms in a building, especially in offices, or between two areas/compartments of means of locomotion by land, air or sea, or for fitting into windows or display counters, or any type of container.

Furthermore, the luminous structure may form an integral part of a double glazing unit as a replacement for one of the glass panes of the double glazing unit, or by being associated with, for example incorporated into, the double glazing unit.

The invention also relates to the construction of architectural or decorative elements that are illuminating and/or have a display function, such as, in particular, flat luminaires, luminous, especially suspended, walls, luminous tiles, etc.

In the present invention, the expression "substantially transparent part" (or alternatively "substantially transparent surface") refers to that part of the luminous structure (or alternatively the surface of the switchable element) forming a uniform light well (or alternatively a surface of the switchable element).

In the present invention, the expression "overall transparent part" (or alternatively "overall transparent surface") refers to that part of the luminous structure forming a light well (or alternatively a surface of the switchable element) made of a material that is capable of absorbing or reflecting a substantial fraction of the light radiation but is distributed over a certain fraction of the structure (or alternatively of the switchable element) in a pattern such that sufficient visible light is transmitted.

Such a material may be arranged in the form of a grid or an array of geometrical features. This arrangement may be obtained from a coating deposited by any means known to those skilled in the art, such as liquid deposition, vacuum deposition (evaporation, magnetron sputtering), by pyrolysis (powder or chemical vapor deposition), or by screen printing. It is possible to employ masking systems for obtaining the desired distribution directly, or else to etch a uniform coating by laser ablation or by chemical or mechanical etching.

This material may also be a functional material, for example an opaque photoluminescent material of the light source or else the reflective material of the switchable element and/or a decorative material.

Preferably, at least in the light well, the transmission factor—or the overall transmission factor in the presence of a relatively absorbent and/or reflective material—at around 550 nm is 10% or higher, preferably 30% or higher, even more preferably 50% or higher and even 70% or higher.

Even more advantageously, the light transmission (where appropriate, the overall transmission) is 10% or higher, preferably 30% or higher, more preferably 50% or higher and even 70% or higher.

Furthermore, it may be advantageous to incorporate a coating having a given functionality into the luminous structure according to the invention. This may be a coating with the function of blocking radiation with wavelengths in the infrared (for example using one or more silver layers surrounded by dielectric layers, or layers made of nitrides such as TiN or ZrN or metal oxides or steel or an Ni—Cr alloy), having a low-emissivity function (for example made of a doped metal oxide such as $SnO_2$:F or tin-doped indium oxide (ITO) or one or more silver layers), having an antifogging function (by means of a hydrophilic layer) or an antisoiling function (photocatalytic coating containing $TiO_2$ at least partially crystallized in the anatase form), or else an antireflection multilayer, for example of the $Si_3N_4/SiO_2/Si_3N_4/SiO_2$ type.

The luminous structure may be semitransparent in the sense that one or more regions may be overall or substantially transparent (for example in the central region of a window) and one or more regions may be opaque or semi-opaque (for example one or more borders of a window).

An opaque or overall or substantially transparent region may include a decorative luminous pattern or display, such as a logo or a trademark.

An opaque region may have a concealing function, for preserving privacy.

The luminous structure may have one or two luminous faces and the illumination may be uniform on one or each face or may be associated with one or more specific regions.

It is possible to create on one and the same surface one or more luminous regions of intense light and one or more luminous regions of screened light.

The luminous structure may be of any size, depending on the desired application.

The walls may be of any shape: their outline may be polygonal, concave or convex, especially square or rectangular, or curved, with a constant or variable radius of curvature, especially round or oval.

The walls may be flat or domed, and are preferably held at a constant distance apart, for example by spacers such as glass balls.

The walls may preferably be glass substrates with an optical effect, especially colored substrates, decorated substrates, structured substrates, diffusing substrates, etc.

The structure may be sealed by a mineral material, for example with a glass frit.

The switchable element is preferably of the same shape as the walls, for example flat shape.

The structure may include a single switchable element, serving for one or all of the luminous areas on a given face, or it may include a plurality of switchable elements dedicated to predefined luminous areas on a given face or on both faces.

In one advantageous embodiment, the reflective surface is placed to the outside of the internal space.

Preferably, one part of the switchable element or the entire switchable element may be placed to the outside of the internal space.

In this way, it is for example easily possible to combine a conventional luminous structure with the switchable element.

The switchable element with the reflective surface may have an external reflection factor of 30% or less at around 550 nm, preferably 20% or less and more preferably 10% or less.

Preferably, the switchable element with the reflective surface may further have an external light reflection $R_{L1}$ measured at normal incidence of 30% or less, preferably 20% or less (the value being averaged over the range of wavelengths in the visible).

This allows the level of reflection of the luminous structure to be controlled, for example in order to meet the antidazzling standards in force for building facades.

Preferably, the switchable element with the reflective surface may have an internal light reflection $R_{L2}$ of 50% or more, preferably 60% or more, or even more preferably 70%, for better efficiency.

The switchable element with the substantially transparent surface may have, within said area, a light transmission $T_L$ of 10% or higher, preferably 25% or higher and even more preferably 50% or higher.

Likewise, the switchable element with the substantially transparent surface may have, within said area, a light transmission $T_L$ of 10% or higher, preferably 25% or higher and even more preferably 50% or higher.

The switchable element with the reflective surface may furthermore have, in said area, a light transmission $T_L$ of 10% or less, preferably 1% or less and even more preferably 0.1% or less.

Preferably, the structure may include means for adjusting the level of reflection of the reflective surface.

Thus, it is possible to choose to place said surface in an intermediate state, for example in order to obtain an internal light reflection $R_{L2}$ of around 50% and a light transmission $T_L$ of around 30%, so as to redirect most of the light toward one side, for example the interior of a room, whilst still leaving part of the light illuminating the other side, for example the outside, in order to provide subdued lighting Thus, the first and second luminous regions being associated with said respective faces, the illumination is unsymmetrical. For example, it is possible to choose an 80%/20% distribution of the illumination.

Moreover, the switchable element and the light source may be able to operate independently. It is thus possible to increase the number of functionalities, while decoupling the operations. By leaving the surface reflective when the light source is powered, one-side illumination (unidirectional illumination) is favored. By leaving the surface reflective when the light source is not supplied, mirror and/or sealment functions are obtained. By leaving the surface transparent when the light source is supplied, a bidirectional illumination may be obtained. By leaving the surface transparent when the light source is not powered, the light transmission is optimized.

The luminous structure may have one or more substantially opaque regions (whether luminous or not) and one or more transparent regions (whether luminous or not).

The structure may include peripheral a region that is at least overall opaque, preferably luminous and associated with either the reflective surface or the transparent surface.

This opaque region may form a continuous background or it may form a logo, a brand name, a drawing or else for example it may be in the form of an array of opaque geometrical features (square, round, etc), for example with a gradation, the size of the pattern decreasing toward the center of the structure, for example keeping a constant spacing between each row of features.

The luminous region may cover substantially said main face and preferably provide a uniform illumination.

According to one characteristic, the intensity I may be equal to 100 $Cd/m^2$ or higher, preferably 500 $Cd/m^2$ or higher.

Moreover, the light flux L may be equal to 300 lumens or higher, preferably 500 lumens or higher, for an area of 0.4 $m^2$.

The element with the reflective surface makes it possible to increase the intensity by 20% or more.

The illumination of several luminous regions—distributed either on one wall or on both walls—may be differentiated.

In one configuration of the invention, when the structure comprises a plurality of luminous regions associated with one of said faces, the degree of coverage of the luminous regions is preferably 10% or higher, preferably 50% or higher.

The boundaries of the luminous region may be sharp or blurred.

In one advantageous embodiment, the switchable element comprises a reversible electrochemical mirror.

Such a reversible electrochemical mirror (REM) is for example disclosed in the article entitled "*Reversible Electrochemical Mirror (REM) Smart Window*" by D. M. Tench et al., Proceedings of the 203rd Meeting of the Electrochemical Society, Apr. 27-May 2, 2003, page 1294.

The reversible electrochemical mirror may comprise, in succession:

a first substrate;
first nucleation sites;
an electrolyte;
second nucleation sites;
a second substrate; and
between the first and second nucleation sites, atoms of a metal material, the first nucleation sites being sufficiently far apart for the metal material to form said transparent surface by electrodeposition and the second nucleation sites being sufficiently close together for the metal material to form said reflective surface by electrodeposition.

The metal material may be silver, copper or bismuth, and the substrates may be of the glass type. To provide the current, two transparent electroconductive layers associated with the substrates may be used.

The switchable element may also comprise a multilayer that includes an active layer based on a metal hydride or rare-earth hydride, for example based on gadolinium magnesium hydride, yttrium hydride or lanthanum hydride, or else based on an alloy containing nickel and magnesium, the active layer having the reflective surface capable of being made transparent by means of a reserve of gas or by means of an operation of the electrochromic type by migration of monovalent ions, such as $H^+$, $Li^+$, $K^+$ ("all solid-state").

A first type of switchable element with a reserve of gas is for example disclosed in the article entitled "Mg—Ni—H films as selective coatings; tunable reflectance by layered hydrogenation" by J. L. M. van Michelen et al., Applied Physics Letters, Vol. 84, Number 18, pp 3651-3653, 27, (2004).

A second type of "all solid-state" switchable element is for example disclosed in the article entitled "*Solid-state gadolinium-magnesium optical switch*" by R. Armitage et al., Applied Physics Letters, Vol. 75, Number 13, pp 1863-1865, 27, September 1999. In one operation of the all solid-state type, this multilayer may comprise, in succession:

the active layer based on a metal or rare-earth hydride;
a palladium layer;
an electrolyte layer; and
a tungsten oxide layer.

The whole assembly may for example be deposited by magnetron sputtering on a substrate, and the assembly may be laminated with one or two substrates or may be assembled with a gas layer in a structure of the double glazing type.

To deliver an electrical current, two transparent electroconductive layers (made of ITO, $SnO_2$:F, etc.) may be used as electrodes.

In the embodiment with an active layer based on a metal or rare-earth hydride or an alloy, the reflective surface may be placed to the outside of the internal space and preferably may be the closest to the internal space.

In this way, the reflective surface is the closest to the light source and also the switchable element has a controlled external light reflection $R_{L1}$.

The light source may comprise a photoluminescent material and preferably at least one of the walls has an internal face at least partly coated with said photoluminescent material.

Such a material can be activated by the action of UV radiation excitation.

It is also possible to envision an electroluminescent material or a plasma gas that emits in the visible, or more generally any phosphor material that can be activated by an electron beam, X-rays or γ-radiation.

All or part of the internal face of at least one of the two walls may be coated (directly or indirectly) with photoluminescent material.

In the case of activation by a plasma gas, differentiated distribution of the photoluminescent material in certain regions of the internal face makes it possible to convert the energy of the plasma into visible radiation only in the regions in question, so as to form luminous regions (which are themselves opaque or transparent depending on the nature of the photoluminescent material) and permanently transparent juxtaposed regions (forming the light wells).

Advantageously, the photoluminescent material may be selected or adapted so as to determine the color of the illumination within a wide palette of colors.

The luminous region may be located round the border. The luminous region may thus form an array of geometrical features (lines, studs, dots, squares or features of any other shape) and the spacing between features and/or the size of the features may be varied (one-dimensional or two-dimensional array, intermeshing of several subarrays). The features may be made of any luminescent material.

Preferably, so as to maintain a satisfactory light transmission when the photoluminescent material is relatively opaque, its width may be limited, for example to a few tens of mm. Nevertheless, the system retains good luminous efficiency.

A red color is obtained for example with $(Y,Gd)BO_3$:Eu, a green color with $LaPO_4$:Ce,Tb and a blue color with $BaMgAl_{10}O_{17}$:Eu.

Advantageously, the luminescent material may be substantially transparent and preferably comprises phosphor particles dispersed in a matrix.

A red color is obtained with $YVO_4$:Eu or $Y_2O_3$:Eu and a green color with $LaPO_4$:Ce,Tb.

For example, the matrix is inorganic and comprises, particularly preferably, lithium silicate. Alternatively, the matrix comprises a product resulting from the polymerization/polycondensation of a silicon alkoxide such as tetraethoxysilane (TEOS), tetramethoxysilane (TMOS), methyltriethoxysilane (MTEOS) and the like. These precursors of the matrix offer excellent compatibility with numerous phosphor particles among those mentioned above.

The structure may incorporate a flat lamp with various electrode configurations:

external or internal coplanar electrodes, as described in documents US 2004/0155571 A1 and U.S. Pat. No. 6,034,470;
two electrodes associated respectively with the two walls and with the outside of the internal space, as described in document WO 2004/015739 A2;

one electrode on each internal face of the walls, as described in the document by Kwak et al., IEEE Transactions on Plasma Science, Vol. 31, No. 1, 2003, pp 176-179; and a hybrid structure, one electrode being on an internal face and the other on an external face.

The switchable element may be used to improve the illumination toward the outside or the illumination of a room.

The power supply may preferably include two electrodes outside the internal space and associated with the respective chosen walls of the glass type.

One electrode or the electrodes may for example be in the form of a conducting grid, preferably letting light pass through it owing to the nature of the conductor and/or owing to the fineness and the pitch of the grid, for example one integrated into a glass substrate (reinforced glass) or integrated into a plastic film, such as a polyvinyl butyral (PVB), ethylene/vinyl acetate (EVA) or other film, where appropriate inserted between two sheets of plastic.

The electrodes may also be in the form of layers, possibly covering all or part of the external or internal faces. It is also possible to furnish only certain areas of the face of one or both walls so as to create predefined luminous regions on the same surface.

For example, in plane-plane technology (noncoplanar electrodes), these layers may be in the form of arrays of parallel bands, with a band width of between 0.1 and 15 mm, and a nonconducting space between two adjacent bands, the width of the space being greater than the width of the bands. These layers may therefore be offset by 180° so as to prevent two opposed conducting bands of the two walls from facing one another. This makes it possible advantageously to reduce the effective capacitance of the glass substrates, favoring the power supply for the lamp and its efficiency in lumens/W.

These layers may consist of any conducting material that can be made in the form of a flat element that lets light pass through it, especially one that can be deposited as a thin layer on glass or on a film of plastic such as PET. In particular, it is preferred to form a transparent coating based on a conducting metal oxide or an oxide having electron vacancies, such as fluorine-doped tin oxide or mixed indium tin oxide of the ITO type.

The structure may include at least one transparent element covering one of the electrodes and chosen from a glass substrate and/or a plastic film.

The transparent element may be coated on its external face with a low-emissivity or solar-protection layer.

More generally, the structure may include a low-emissivity or solar-protection layer.

The space between the walls may be kept constant and preferably the structure is flat.

To save on thickness and to increase integration, the structure may also be a hybrid structure in the sense that at least one element is common between the part including the light source and the switchable element.

The subject of the invention is also an assembly or ready-to-use kit, which comprises at least one luminous structure and/or its constituent elements to be combined, as described above.

The subject of the invention is also the use of the luminous structure as described above as glazing for a vehicle or as windows for a building.

Finally, the subject of the invention is a double glazing unit incorporating at least one luminous structure as described above.

Figure 2:
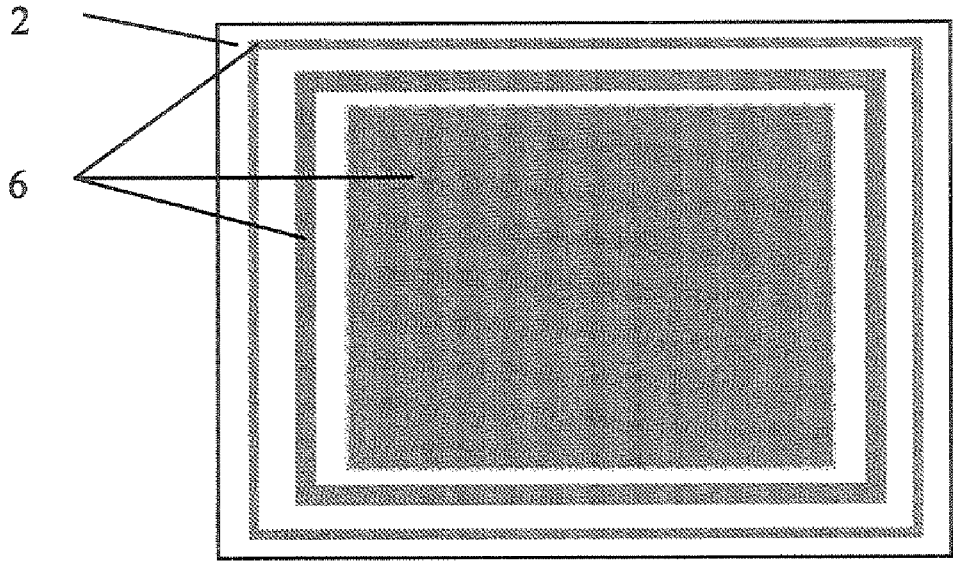
Figure 3:
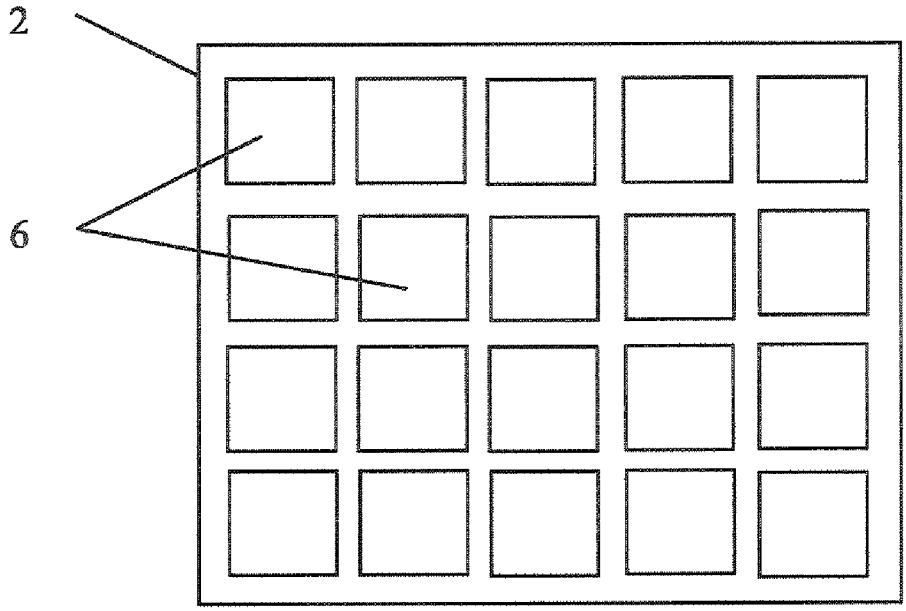
Figure 4:
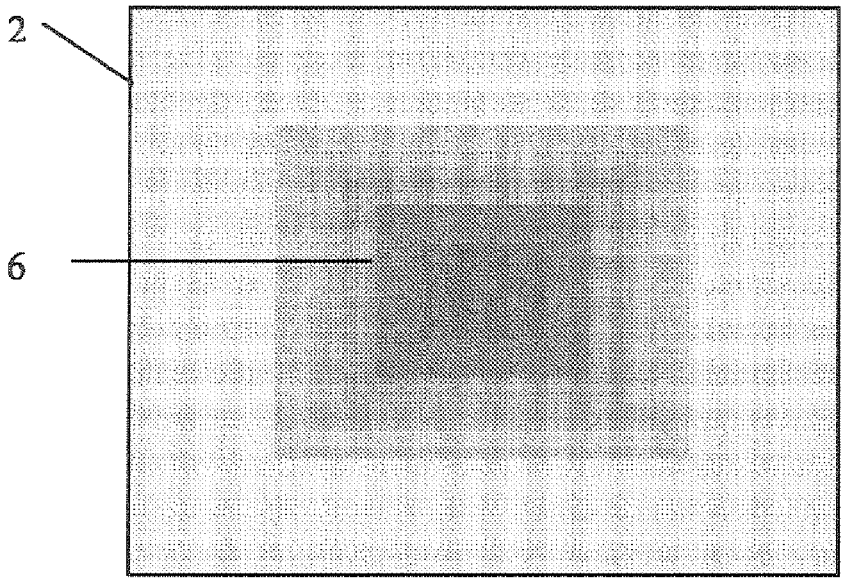
Figure 5:
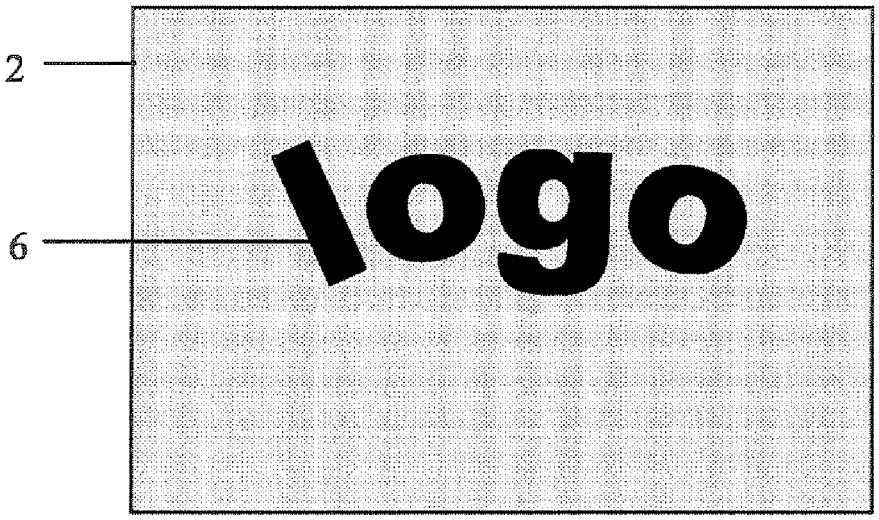
Figure 6:
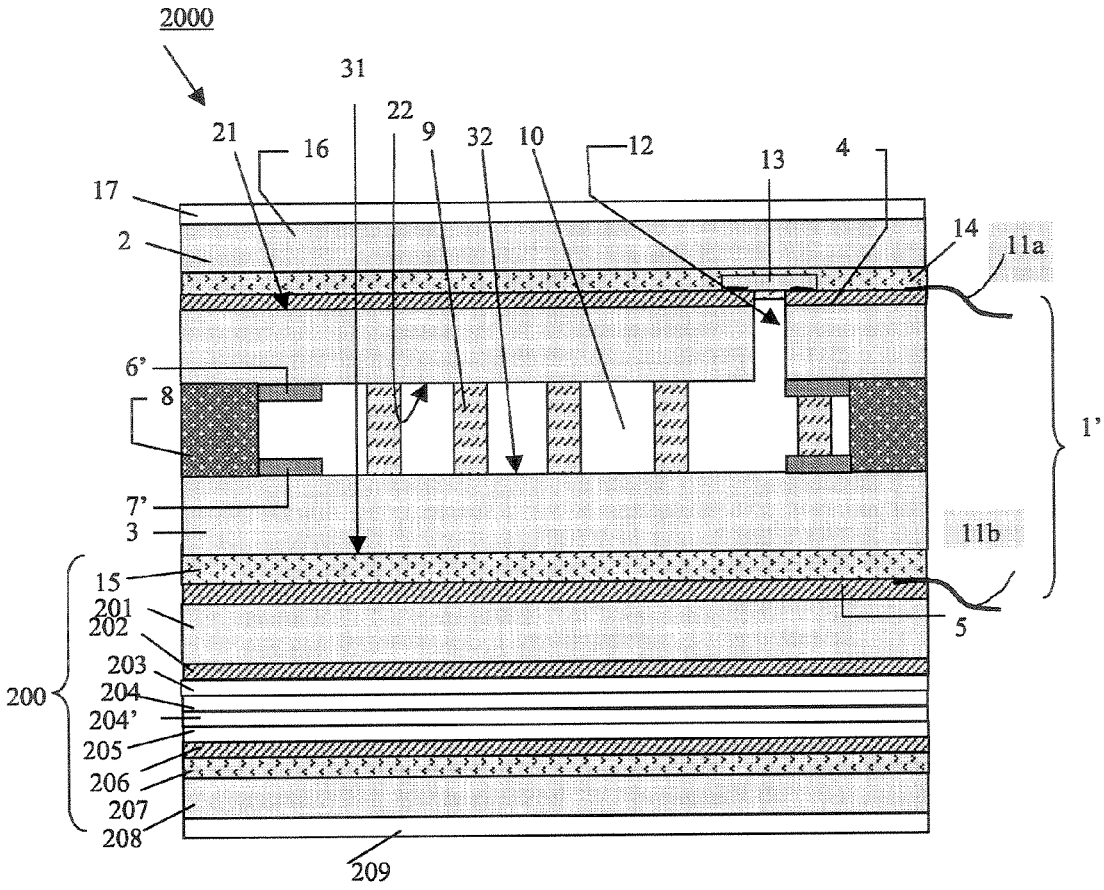
Figure 7:
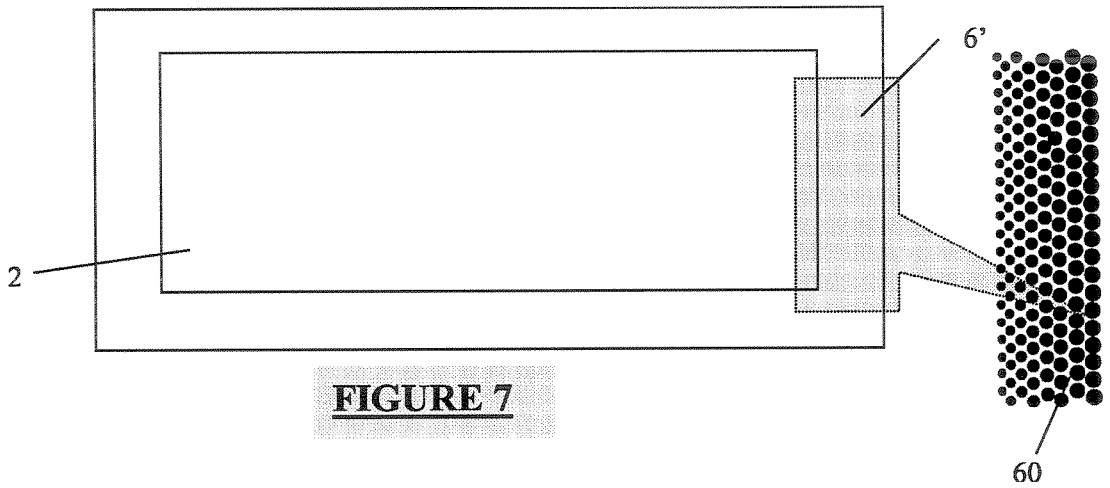
Figure 8:
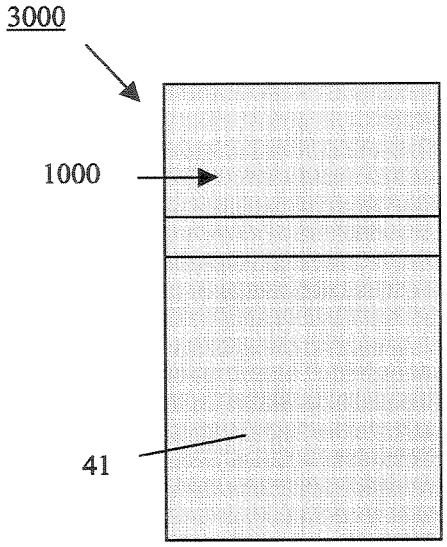
Figure 9:
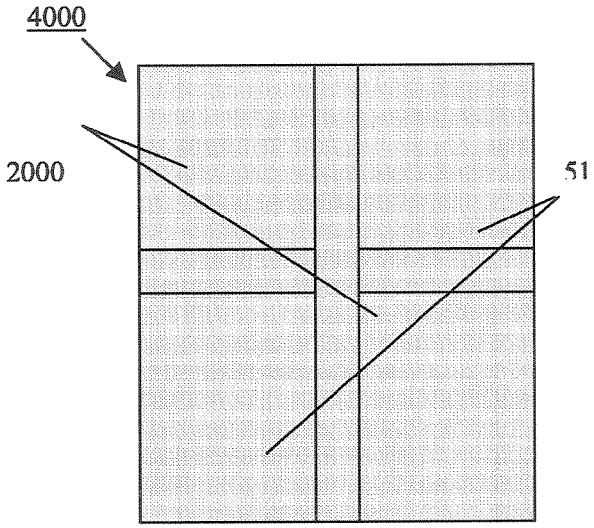
Figure 10:
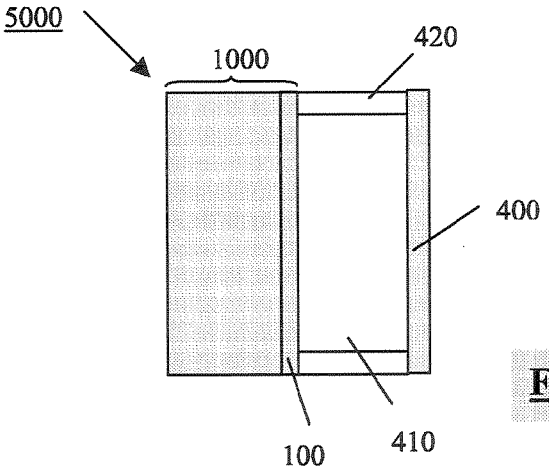

The invention will be explained in detail below with the aid of nonlimiting examples illustrated by the following figures:

FIG. 1: a transverse sectional view of a flat luminous structure with a switchable element in a first embodiment of the invention;

FIG. 2: a front view of a first arrangement of the photoluminescent material of the luminous structure in a first variant of the first embodiment of the invention;

FIG. 3: a front view of a second arrangement of the photoluminescent material of the luminous structure in a second variant of the first embodiment of the invention;

FIG. 4: a front view of a third arrangement of the photoluminescent material of the luminous structure in a third variant of the first embodiment of the invention;

FIG. 5: a front view of a fourth arrangement of the photoluminescent material of the luminous structure in a fourth variant of the first embodiment of the invention;

FIG. 6: a cross-sectional view of a flat luminous structure with a switchable element in a second embodiment of the invention;

FIG. 7: an arrangement of the photoluminescent material of the luminous structure in a variant of the second embodiment of the invention;

FIGS. 8 and 9: front views of systems integrating one or more luminous structures having a switchable element in accordance with the invention; and FIG. 10: a side view of an illuminating double glazing unit according to the invention.

It should be pointed out that for the sake of clarity the various elements of the objects shown have not necessarily been drawn to scale.

EXAMPLE 1

This relates to the glazing shown schematically in FIG. 1 (the various materials shown have not been drawn to scale so as to make it easier to examine the drawing).

FIG. 1 shows a structure 1000 comprising:

a flat lamp 1 formed mainly by two substrates made from first and second glass sheets 2, 3 that define an internal space 10 having an external face 21, 31; and a switchable element 100 having a surface that is reflective or substantially transparent in the visible, placed opposite the external face 31.

The internal face 22, 32 of the first and second glass sheets 2, 3 bears a coating of transparent photoluminescent material 6, 7 that emits white light for example.

Deposited directly on the external faces 21, 31 are continuous uniform conductive coatings 4, 5 constituting first and second electrodes, preferably transparent electrodes, for example made of $SnO_2$:F or ITO.

The electrodes 4, 5 are connected to a high-frequency power supply source via flexible shims 11*a*, 11*b*.

The switchable element 100 also includes electrodes 102, 106, preferably in the form of transparent layers, for example made of fluorine-doped $SnO_2$. A potential difference of typically between −1 V and +1 V is applied.

Placed on the external face 21 is a transparent plastic film 14 of the polyvinyl butyral (PVB) type, which film serves as insert for lamination to a glass sheet 16. An adhesive resin may also be used.

As a variant of structures having noncoplanar electrodes, the plastic film 14 may incorporate the electrode 4—in the form of a metal grid—for example made of polyvinyl butyral (PVB) or ethylene/vinyl acetate (EVA), or else the film may be coated on its internal face with the electrode 4. The electrode 4 may also be on the internal face of the glass sheet 16 or in the glass sheet 16 (reinforced glass).

Preferably, this glass sheet 16 is coated on its external face with a transparent, low-emissivity or solar-protection layer 17 (either a monolayer or a multilayer).

In another variant, it is also possible to place a flexible or rigid transparent plastic film 14, made of PET, ionomer resin, etc., which may serve as protective substrate for the first electrode 4.

It is also possible to provide, in a novel variant, a transparent plastic sheet, such as a polycarbonate sheet or an insert such as a polyurethane insert.

Placed on the external face 31 is a transparent plastic film 15, for example an EVA film, or an appropriate resin serving as insert for lamination to a glass substrate 101 forming part of the switchable element 100.

As a variant, the plastic film 15 may incorporate the electrode 5—in the form of a grid—or it may include the electrode 5 on its internal face. The electrode may also be on the glass substrate 101.

Any type of adhesive capable of making the glass sheets 3, 101 adhere to each other may also be used.

The sheets 2, 3 are brought together with their second faces 22, 32 bearing the transparent photoluminescent material 6, 7 facing each other and are joined together, for example by means of a sealing frit 8, the gap between the glass sheets being set (generally with a value of less than 5 mm) by glass spacers 9 placed between the sheets. Here, the gap is around 0.3 to 5 mm, for example 0.4 to 2 mm.

The spacers 9 may have a spherical shape. The spacers may be coated, at least on their lateral surface exposed to the plasma gas atmosphere, with the same or different transparent photoluminescent material 6, 7.

In the space 10 between the glass sheets 2, 3 there is a reduced pressure, generally of the order of one tenth of atmospheric pressure, of a rare gas such as xenon, optionally mixed with neon or helium.

A glass sheet 2 has, near the periphery, a hole 12 pierced through its thickness, the external opening of which is obstructed by a sealing pad 13, especially made of copper soldered to the external face of the sheet bearing the electrode 4.

The process for manufacturing the part 1 with the light source is described in application WO 2004/015739 A2.

The switchable element 100 is a reversible electrochemical mirror comprising, in succession:

- the glass substrate 101 or, as a variant, a transparent plastic substrate, such as a PET-based material, or any composite substrate;
- the first electrode 102;
- first nucleation sites 103, for example made of platinum;
- an electrolyte 104, for example a mixture of AgI and LiBr in a γ-butyrolactone solvent;
- second nucleation sites 105, for example made of platinum;
- the second electrode 106;
- a transparent substrate, preferably a glass sheet 107, or, as a variant, a transparent plastic substrate or any composite substrate, whether flexible or rigid; and
- optionally, a low-emissivity or solar-protection layer 108.

The first nucleation sites 103 are close together whereas the second nucleation sites 105 are far apart. Atoms $M^+$ of a metal material, preferably silver, are capable of forming, by electrodeposition, a reflective surface 109 or semireflective surface (intermediate state) on the first sites 103, or a substantially transparent surface (not shown), in the form of conducting islands on the second sites 105.

Means are provided (but not shown) for controlling the level of reflection of the reflective surface, by adjusting the voltage, by measuring the amount of current or by electrical resistance measurements.

The switchable element 100 and the flat lamp 1 are able to operate independently. The structure 1000 has a light transmission $T_L$ of 30% or higher.

Preferably, the structure 1000 is used as illuminating glazing. For example, that side of the structure with the switchable element is turned toward the outside of a building or a vehicle. This favors the illumination of the enclosed space.

With the reflective surface 109, the intensity I of the illumination on the side with the face 31 is at least 500 Cd/m$^2$, an estimated increase of about 30% compared with a conventional luminous structure. The light flux L is at least 500 lumens for an area of 0.4 m$^2$, i.e. an estimated increase of about 30%.

The reflective surface 109 also has the solar-protection property.

By leaving the surface reflective, when the flat lamp is turned off, mirror and/or concealment functions are obtained. By leaving the surface transparent when the lamp is turned on, bidirectional illumination is obtained. By leaving the surface transparent, when the lamp is turned off, a conventional window with a maximum light transmission $T_L$ is produced.

In a variant of this embodiment, the reflective surface covers an area of less than that of the external face, for example by positioning a smaller element or by limiting, via the first and second nucleation sites, to one or more regions.

Since the transparent photoluminescent materials 6 entirely cover the internal faces, the illumination is uniformly distributed.

In a first variant, shown in FIG. 2, the photoluminescent materials 6 uniformly cover a central region of the internal faces and then form frames uniformly spaced apart (with a constant distance therebetween) and of width decreasing toward the edges of the structure. The percentage area of luminous regions is 50%. The light transmission $T_L$ in the central region is 30%.

In a second variant, shown in FIG. 3, the photoluminescent materials 6 are opaque and arranged in an array of square geometrical features. The percentage area of luminous regions is for example 75%. The overall light transmission $T_L$ is 20%.

In a third variant, shown in FIG. 4, the photoluminescent materials 6 are arranged to form a large central luminous region with fuzzy boundaries.

In a fourth variant, shown in FIG. 5, the photoluminescent materials 6 form a luminous logo.

Each luminous region may be made of a different material, for example so as to provide a multicolored illumination.

EXAMPLE 2

This relates to the glazing shown schematically in FIG. 6 (the various materials shown have not been drawn to scale so as to make it easier to examine the drawing).

FIG. 6 shows a structure 2000 comprising:

- a flat lamp 1' formed mainly by two substrates made from first and second glass sheets 2, 3 that define an internal space 10 filled with a plasma gas and having an external face 21, 31; and
- a switchable element 200 having a surface that is reflective or substantially transparent in the visible, placed opposite the external face 31.

The internal face 22, 32 of the first and second glass sheets 2, 3 bears a coating of opaque photoluminescent material 6', 7'. The material 6', 7' is placed around the periphery in order to leave a region of maximum transparency clear.

Deposited directly on the external face 21 is a continuous uniform conductive coating 4 constituting a first electrode, preferably a transparent electrode, for example made of fluorine-doped $SnO_2$.

A second electrode 5 is associated with the external face 31.

The electrodes 4, 5 are connected to a high-frequency power supply source via flexible shims 11*a*, 11*b*.

The switchable element 200 also includes electrodes 202, 206, preferably in the form of transparent layers made of fluorine-doped $SnO_2$ or ITO, one electrode being grounded and the other with a DC potential difference that can be adjusted typically between −3 V and +3 V.

Placed on the external face 21 is a plastic film 14, for example of the EVA or PVB type, which film serves as insert for lamination to a glass substrate, for example a glass sheet 16.

As a variant, the film 14 may incorporate the electrode 4—in the form of a grid—or it may include, on its internal face, the electrode 4, or else the electrode 4 may be on the glass sheet 16.

Preferably, this glass sheet 16 is coated on its external face with a transparent, low-emissivity or solar-protection layer 17 (either a monolayer or a multilayer) in locations where the structure is used as a window.

Placed on the external face 31 is a plastic film 15 of the EVA or PVB type, serving as insert for lamination to a glass substrate 201 forming part of the switchable element 200. The electrode 5 is placed on the internal face (on the internal space side) of this glass substrate 201.

As a variant, the plastic film 15 may incorporate the electrode 5—in the form of a grid—or it may include, on its internal face, the electrode 5 or else the electrode may be on the external face 31.

The switchable element 200 comprises a first substrate 201, for example a glass sheet, coated with:

- the first electrode 202;
- an active layer 203 based on a metal hydride, this layer giving a reflective or transparent surface depending on its hydrogen content;
- a palladium layer 204;
- an electrolyte layer 204', for example an inorganic solid-state electrolyte layer, for example based on $Ta_2O_5$ or $ZrO_2$;
- a tungsten oxide layer 205 forming the reserve of hydrogen; and
- the second electrode 206.

The switchable element 200 further includes a transparent protective element preferably consisting of:

- a lamination insert 207, for example plastic film of the PVB, EVA or polyurethane type, with possibly a sheet of the PET type;
- a glass sheet 208; and
- optionally, a low-emissivity or solar-protection layer 209.

In a first variant, the protective substrate is a simple plastic film, whether flexible or rigid, bonded to the electrode 206. The protective substrate may also be unnecessary, for example if the structure replaces the first of the glass sheets of a double glazing unit and when the electrode 206 is facing the second glass sheet of this double glazing unit.

In a second variant, the substrate coated with the elements 202 to 206 becomes the outermost substrate and, in this case, it is the electrode 206 that is in contact with this substrate, followed, in succession, by the layer 205, the electrolyte 204', the layer 204 and the active layer 203. In this configuration, the innermost substrate serves for assembly—it may be a glass pane or a transparent plastic film.

Means are provided (but not shown) for regulating the level of reflection of the reflective surface, by adjusting the value of the potential difference.

The switchable element 200 and the part forming the flat lamp 1' are able to operate independently.

When the layer 203 is in the reflecting state, the switchable element 200 has, on the external side (opposite the space 10), an external light reflection $R_{L1}$ Of less than 20%.

At the center, the structure 2000 has a light transmission $T_L$ of around 20%.

Preferably, the structure 2000 is used as illuminating glazing. For example, that side of the structure with the switchable element is turned toward the outside of a building or a vehicle. This favors the illumination of the enclosed space.

When the layer 203 is in the reflecting state, the intensity I of the border illumination on the side with the face 31 is at least 500 Cd/m$^2$, i.e. an estimated 30% increase. The light flux L is at least 500 lumens for an area of 0.4 m$^2$, i.e. an estimated 30% increase.

The layer 203 in the reflecting state also has the solar-protection property.

In a variant of this second example, the reflective surface covers an area of less than that of the external face, for example by positioning a switchable element of smaller size or by etching only the electrode or the multilayer formed by the layers 202 to 206.

In another variant, shown in FIG. 7, the photoluminescent materials 6 form an array of geometrical features 60, for example dots, the size of which decreases toward the center of the substrate 2. The switchable element serves to increase the illumination and, in the transparent state, makes it possible to maintain an attractive appearance.

FIG. 8 is a front view of an illuminating window 3000 incorporating a luminous structure having a switchable element according to the invention.

This window is provided with a luminous structure, for example the luminous structure 1000 of FIG. 1, forming a transom. A conventional insulating glazing panel 41 is placed in the lower part.

FIG. 9 is a front view of a window 4000 incorporating two flat luminous structures with a switchable element in accordance with the invention.

The window 4000 is a window provided, in the upper left part and the lower right part for example, with the luminous structure 2000 of FIG. 2. Two conventional insulating glazing panels 51 are placed in the right upper part and left lower part.

FIG. 10 is a side view of an illuminating double glazing unit 5000.

The system 5000 is an illuminating double glazing unit comprising:

- a first glass substrate 400;
- an air space 410 or a space containing a gas mixture consisting predominantly of argon, between two sealing elements 420; and
- a luminous structure according to the invention, for example the luminous structure 1000 of FIG. 1, with its switchable element 100 facing the first glass substrate 400.

Preferably, the luminous structure 1000 is placed on that side that it is desired to illuminate most.

The examples that have been described above do not in any way limit the invention.

In particular, in the embodiments that have just been described, the electrodes were formed from external coatings covering the entire area of the glass sheets, but it is understood that at least one of the glass sheets may bear a group of electrodes formed from several regions each of greater or smaller extent and each coated with a continuous coating.

One or more electrodes may also be in the internal space, and also for example the switchable element having a hydride active layer, the wall serving for example as substrate for the multilayer consisting of the layers 202 to 206 described in example 2.

The electrode assemblies may be applied differently to each of the glass sheets 2, 3 of the luminous structure, it being possible for one glass sheet to have a first assembly while the other glass sheet has another assembly.

Likewise, the luminous source may be the plasma gas.

The invention claimed is:

1. A luminous structure comprising:

two walls having main faces facing one another and defining an internal space;

a light source placed in the internal space and a power supply for the light source;

at least one substantially transparent part or an overall transparent part for forming at least one light well, the structure configured to illuminate via at least one luminous region of at least one of the main faces; and an element having a reflective surface that reflects visible light, placed facing at least one part of the luminous region, wherein the light source includes a photoluminescent material, the photoluminescent material covering less than an entire portion of the main faces of the two walls facing one another, wherein the element is switchable and the reflective surface is configured to become a substantially transparent surface or an overall transparent surface over at least one area, and vice versa, wherein the reflective surface of the element covers an area less than an entire external face of the luminous region.

2. The luminous structure as claimed in claim 1, wherein the reflective surface is placed outside of the internal space.

3. The luminous structure as claimed in claim 1, wherein the switchable element with the reflective surface has an external reflection factor of 30% or less at around 550 nm, or an external light reflection measured at normal incidence of 30% or less.

4. The luminous structure as claimed in claim 1, further comprising means for adjusting a level of reflection of the reflective surface.

5. The luminous structure as claimed in claim 4, wherein first and second luminous regions are associated with the main faces respectively, and wherein the illumination is not symmetrical.

6. The luminous structure as claimed in claim 1, wherein the switchable element and the light source are configured to operate independently.

7. The luminous structure as claimed in claim 1, wherein the structure includes a peripheral region that is at least overall opaque, or luminous.

8. The luminous structure as claimed in claim 1, wherein, at least in a part forming the light well, the structure has a light transmission of 20% or higher.

9. The luminous structure as claimed in claim 1, wherein the luminous region covers substantially at least one of the main faces and provides a uniform illumination.

10. The luminous structure as claimed in claim 1, wherein the switchable element comprises a reversible electrochemical mirror.

11. The luminous structure as claimed in claim 10, wherein the reversible electrochemical mirror comprises, in succession:

a first substrate;

first nucleation sites;

an electrolyte;

second nucleation sites;

a second substrate; and between the first and second nucleation sites, atoms of a metal material, the first nucleation sites being sufficiently far apart for the metal material to form the transparent surface by electrodeposition, and the second nucleation sites being sufficiently close together for the metal material to form the reflective surface by electrodeposition.

12. The luminous structure as claimed in claim 1, wherein the switchable element comprises a multilayer that includes an active layer based on a metal hydride, a rare-earth hydride, or an alloy containing nickel and magnesium, the active layer having the reflective surface configured to be made transparent by a reserve of gas or by migration of monovalent ions.

13. The luminous structure as claimed in claim 12, wherein the multilayer comprises, in succession:

the active layer based on a metal or rare-earth hydride;

a palladium layer;

an electrolyte layer; and a tungsten oxide layer.

14. The luminous structure as claimed in claim 12, wherein the reflective surface is placed outside of the internal space and is closest to the internal space.

15. The luminous structure as claimed in claim 1, wherein the photoluminescent material uniformly covers a central region of the main faces, and then forms frames uniformly spaced apart with a constant distance there between with a width of the frames decreasing toward edges of the luminous structure.

16. The luminous structure as claimed in claim 15, wherein the photoluminescent material is substantially transparent and comprises phosphor particles dispersed in a matrix.

17. The luminous structure as claimed in claim 1, wherein the power supply includes first and second electrodes outside the internal space and associated with respective chosen walls of glass type.

18. The luminous structure as claimed in claim 17, wherein the first and second electrodes are substantially transparent electroconductive layers.

19. The luminous structure as claimed in claim 1, further comprising a low-emissivity or solar-protection layer.

20. The luminous structure as claimed in claim 1, wherein the space between the walls is kept constant and the structure is flat.

21. An assembly or ready-to-use kit, comprising at least one luminous structure and/or its constituent elements to be combined, as claimed in claim 1.

22. The method for making a glazing for a vehicle or a window for a building which comprises utilizing the luminous structure of claim 1.

23. A double glazing unit incorporating at least one luminous structure as claimed in claim 1.

* * * * *